United States Patent [19]

Wagner et al.

[11] Patent Number: 4,735,547

[45] Date of Patent: Apr. 5, 1988

[54] BACKHOE MOUNTING

[75] Inventors: Oryn B. Wagner; Thomas M. Sagaser, both of Bismarck; Carman P. Lynnes, Leonard, all of N. Dak.

[73] Assignee: Clark Equipment Company, South Bend, Ind.

[21] Appl. No.: 28,414

[22] Filed: Mar. 20, 1987

Related U.S. Application Data

[63] Continuation-in-part of Ser. No. 770,117, Aug. 27, 1985, abandoned.

[51] Int. Cl.[4] ..... B66C 23/00

[52] U.S. Cl. ..... 414/686; 172/413; 172/481

[58] Field of Search ..... 414/685, 686, 687, 688, 414/694, 695.5; 172/413, 466, 481

[56] References Cited

U.S. PATENT DOCUMENTS

| | | | |
|---|---|---|---|
| 2,593,176 | 4/1952 | Patterson | 172/481 X |
| 3,876,092 | 4/1975 | MacDonald . | |
| 4,388,038 | 6/1983 | Freitag | 414/685 |

*Primary Examiner*—L. J. Paperner
*Assistant Examiner*—Donald W. Underwood
*Attorney, Agent, or Firm*—Kenneth C. Witt

[57] ABSTRACT

A mechanism for mounting a backhoe on a vehicle including a backhoe mounting subframe having a downwardly extending work position and a transport position in which it is pivoted upwardly and outwardly from the work position. The backhoe mounting subframe is pivotally mounted about an axis transverse to the frame of the vehicle. The backhoe mounting subframe is movable at the operator's option between the work position and the transport position, and means are provided for positively latching the backhoe mounting subframe to the vehicle frame either at the work position or at the transport position.

5 Claims, 4 Drawing Sheets

BACKHOE MOUNTING

CROSS REFERENCE

This is a continuation-in-part of U.S. application Ser. No. 06/770,117 dated Aug. 27, 1985, now abandoned.

BACKGROUND OF THE INVENTION

1. Field of the Invention

This invention relates to excavator machines and more particularly to vehicles on which a backhoe is mounted to form an excavator machine.

2. Description of the Prior Art

Attempts have been made heretofore to maximize the effectiveness and efficiency of backhoes and the vehicles on which they are mounted by reducing the size and weight of both the backhoe and the vehicle for a specified digging depth and capacity, or, stated differently, by increasing the digging depth or capacity without increasing the size and weight. For example, in U.S. Pat. No. 4,272,222 Davis an additional rigid link was added to the previously known backhoe linkage to increase the digging depth of the backhoe. The backhoe boom is articulated so as to present a joint between the inner and outer sections thereof. The joint is located in a position that is spaced outwardly from the point of pivoting attachment of the lift cylinder to the support for the boom, and the rigid link transversely and pivotally interconnects the lift cylinder and the inner section of the boom.

SUMMARY OF THE INVENTION

In the present invention a subframe for mounting a backhoe is pivotally connected to the main frame of the vehicle about a transverse axis near one end of the main frame. Means are provided for selectively pivoting the backhoe mounting subframe between a work position and a transport position. Additional means are provided for securing the backhoe mounting subframe to the vehicle main frame either at the work position or at the transport position. A backhoe is mounted on the backhoe mounting subframe.

DESCRIPTION OF THE PREFERRED EMBODIMENT

Figure 1:
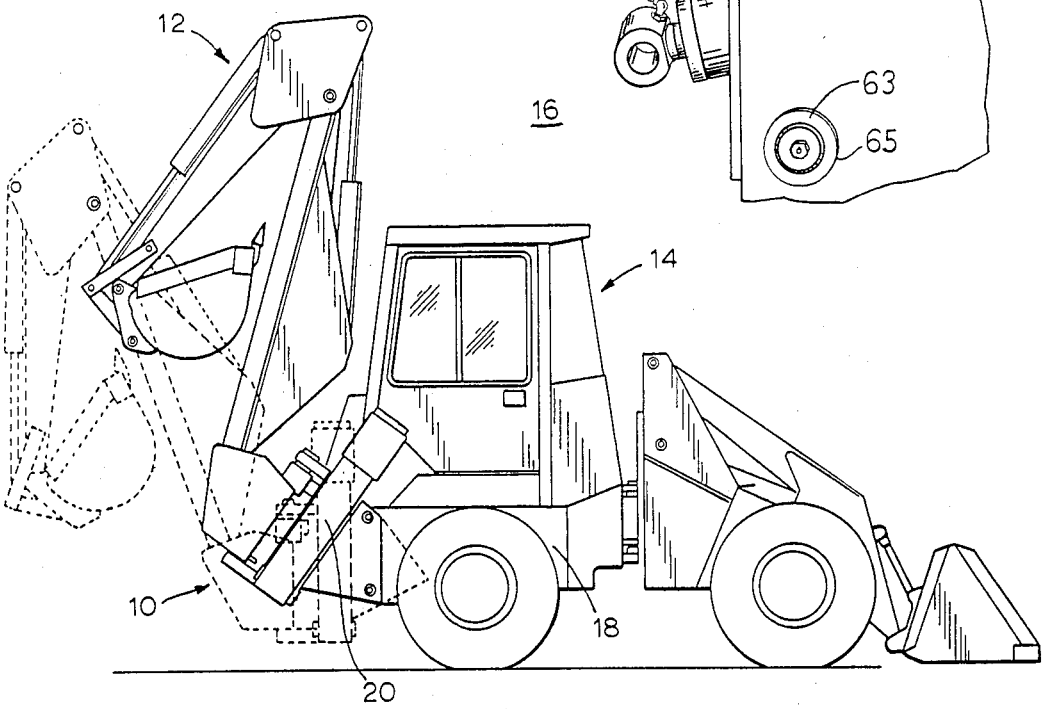
FIG. 1 is a profile view of an excavator machine which embodies this invention.
Figure 4:
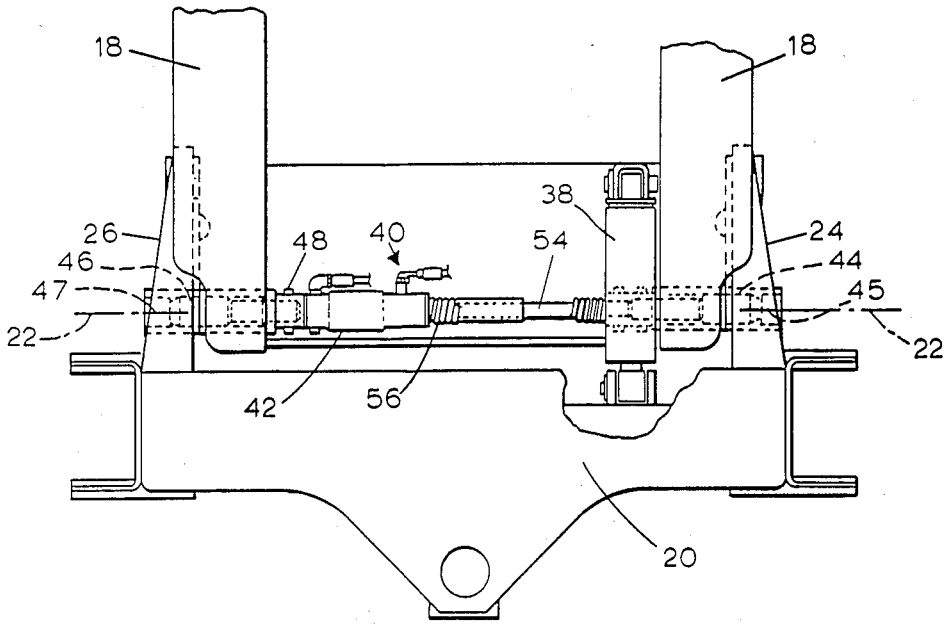
FIG. 4 is a partial plan view of the machine in the work position showing elements of the present invention.
Figure 5:
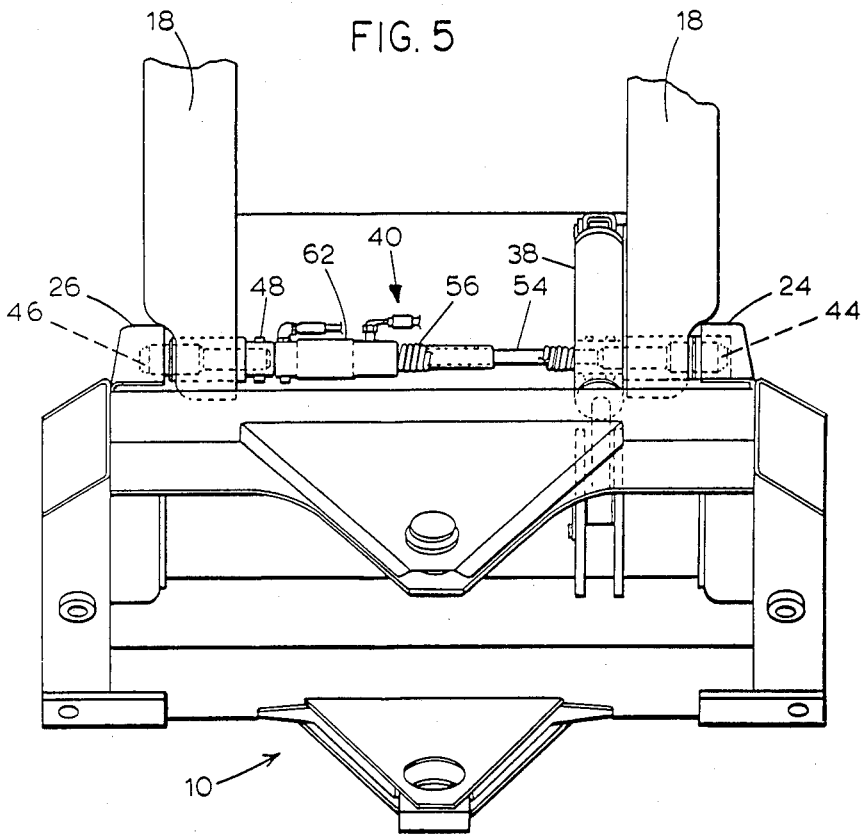
FIG. 5 is a partial view of the machine in the transport position from an elevated position showing pivoting and latching devices.

In FIG. 1 and in other figures the numeral 10 indicates generally a backhoe mounting mechanism in accordance with the present invention. As shown a backhoe 12 is mounted by means of the present invention on a vehicle 14 to form an excavator machine which is designated in its entirety by the numeral 16. The vehicle 14 includes a main frame member 18 which is seen in FIGS. 1–5. A backhoe mounting subframe 20 is pivotally mounted on frame 18 to pivot about axis 22 adjacent the upper margin of the frame. As seen in FIG. 4 the backhoe mounting subframe includes a pair of forwardly extending vertical brackets 24 and 26 connected to the two sides of the vehicle frame 18 to pivot the subframe 20 on frame 18 about axis 22. The axis 22 is formed by a pair of pivot pins on opposite sides of the vehicle and subframe, the pin on the near side in FIGS. 2 and 3 being indicated by the number 28. Subframe 20 also includes a pair of rearwardly extending upper and lower horizontally disposed bracket portions 31 and 32; see FIGS. 2 and 3. Also included in the backhoe mounting mechanism 10 is a swing frame 34 which is connected between horizontal brackets 31 and 32 to pivot about axis 36 with respect to such brackets. This swing frame construction allows the backhoe 12 which is mounted on swing frame 34 to pivot through an arc of almost 180° from one side of the machine to the other.

Figure 2:
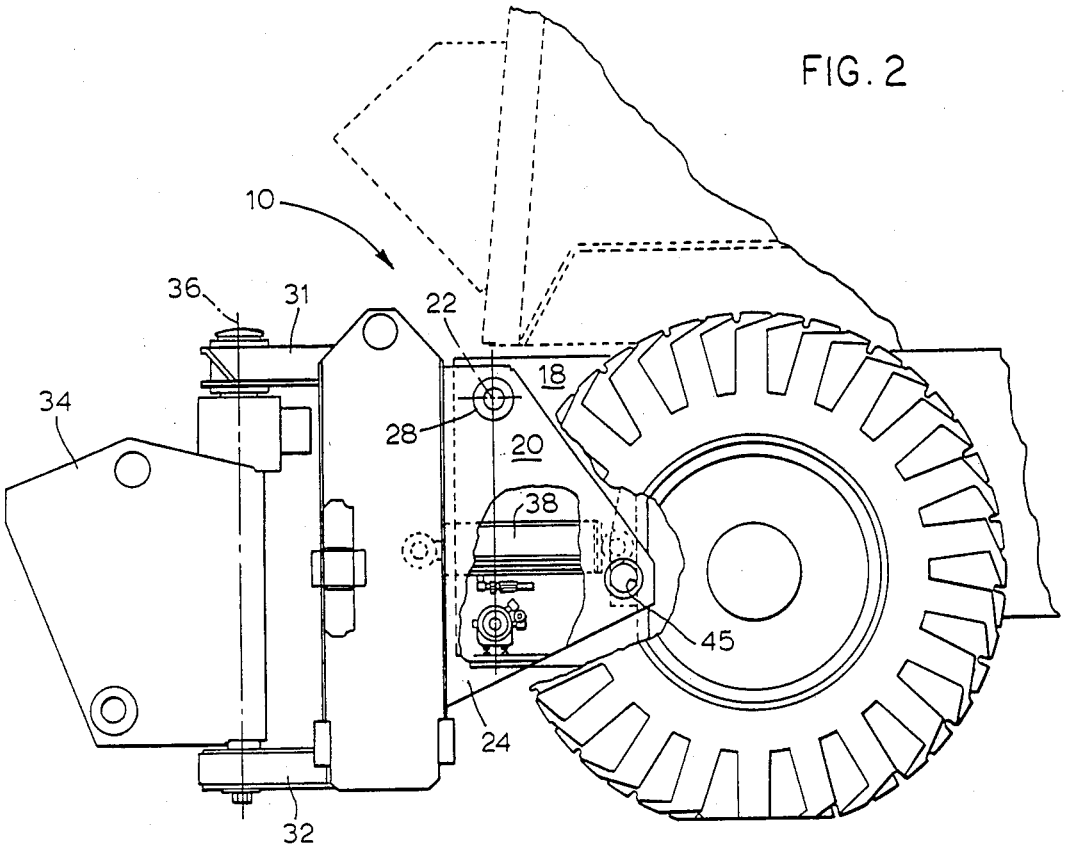
FIG. 2 is a partial side elevation of the machine in the work position.
Figure 3:
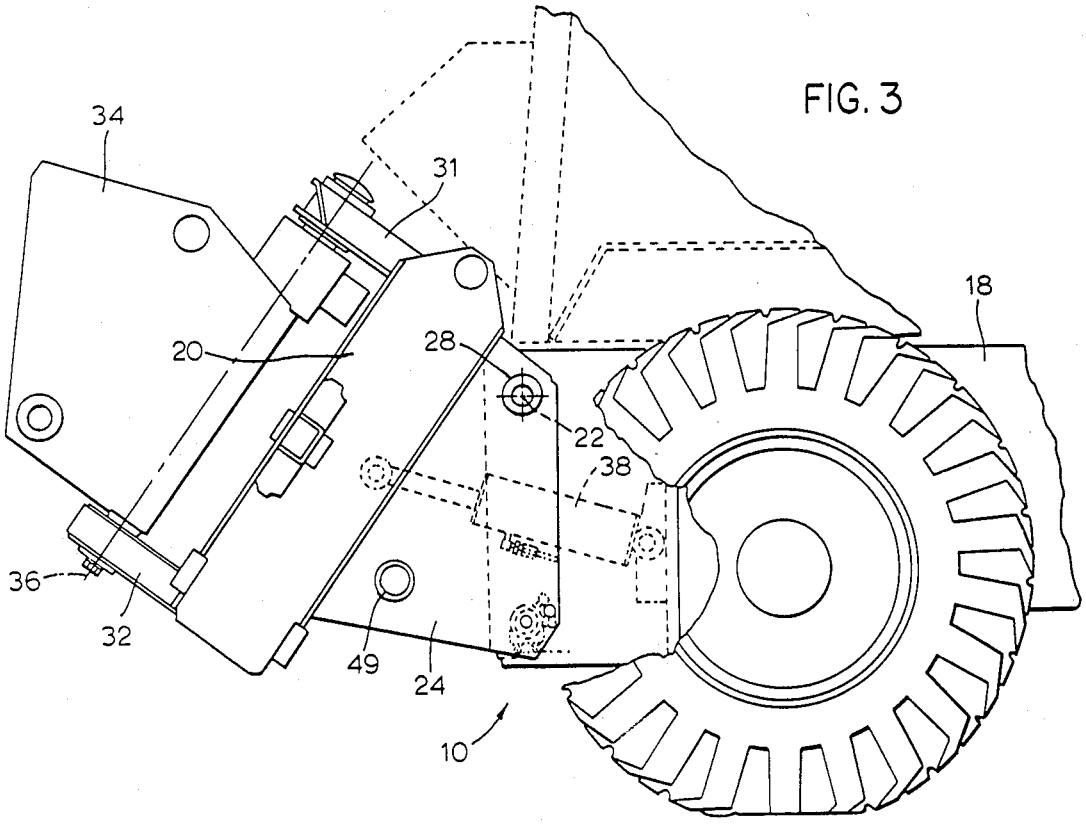
FIG. 3 is a similar partial side elevational view with the machine in the transport position.
Figure 6:
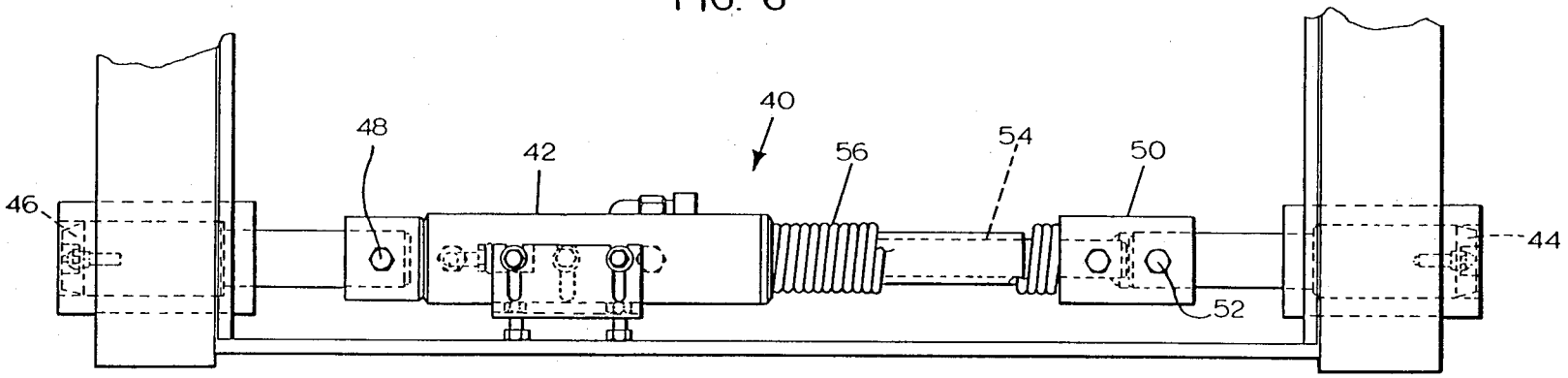
FIG. 6 is a partial view showing a latching device and its cylinder operator in the unlatched position.
Figure 7:
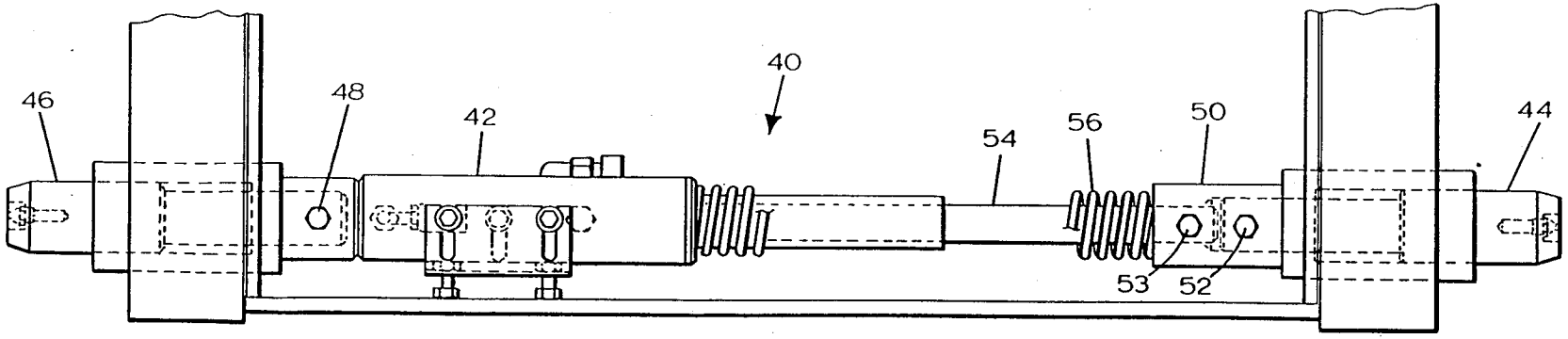
FIG. 7 is a similar view to FIG. 6 except showing the machine in the latched condition.

FIG. 2 of the drawing shows the backhoe mounting subframe 20 in the work position. In this condition a hydraulic cylinder 38 which connects between the subframe 20 and the vehicle main frame 18 is retracted causing the subframe to be pivoted to its lowermost and innermost position. When cylinder 38 is extended the subframe is pivoted upwardly and outwardly to the position shown in FIG. 3. This is the transport position. A transverse latching device 40, mounted on vehicle frame 18, which is shown in FIGS. 4 through 7, is operable by the vehicle operator to latch subframe 20 to vehicle frame 18. Such latching mechanism is shown in the latched condition in FIGS. 4, 5 and 7. In FIG. 6 it is shown in the unlatched condition. The latching mechanism 40 comprises a hydraulic cylinder 42 which is extended to latch the subframe to the main frame and retracted to accomplish unlatching. As illustrated in FIG. 4 the latching mechanism 40 includes pins 44 and 46 at opposite ends of the mechanism which when extended project into openings 45 and 47 respectively in the brackets 24 and 26 on the opposite sides of subframe 20. This is the lowered work position as seen in FIG. 2. There is another pair of openings in brackets 24 and 26, one of which appears at 45 in FIG. 3, into which the pins 44 and 46 project when the machine is in the transport or raised position as in FIG. 3. Referring to FIGS. 6 and 7 pin 46 is connected to cylinder 42 at 48 while pin 44 is connected with a collar 50 at location 52, and collar 50 in turn is connected to the piston rod 54 forming a part of cylinder 42. A spring 56 is provided to urge the latching mechanism 40 toward the latched position when cylinder 42 is not pressurized.

When the cylinder 42 is pressurized and the latching mechanism 40 is in the unlatched condition the backhoe mounting subframe 20 and the backhoe mounted on it may be moved between the work position, shown in dashed lines in FIG. 1, and the transport position, shown in solid lines in FIG. 1, by operating a hydraulic cylinder 38 which is connected between the main frame 18 and the subframe 20. The hydraulic cylinders 38 and 42 both are operated remotely by the operator of the vehicle in a known manner. Reference herein to "hydraulic cylinder" means a double acting linear hydraulic motor comprising an outer barrel portion with both ends closed and an internal piston forming variable volume chambers between the piston and the respective ends of the barrel portion. The piston is mounted on a rod which projects through the closure at one end of the barrel portion.

Pivoting the backhoe 12 and its subframe mounting 20 to the work position allows the lowest part of the subframe and also the backhoe to be closer to the ground than previously known backhoe designs. Since the backhoe is located closer to the ground in the working or digging position it can dig deeper than previously known backhoes with the same length boom and dipper stick. When the backhoe is in the transport position the center of gravity of the backhoe 12 is farther forward than when it is in the work position. This transfers more of the backhoe weight towards the front of the machine 14 giving the machine excellent balance which allows the operator to drive the machine on the highway at transport speed without undue bouncing of the machine or loss of control. When the subframe 20 is in the transport position the lowest part of the backhoe is on the same level as the lowest part of the vehicle frame, which facilitates maneuvering the machine. Another advantage of this invention when the backhoe is in the store position is that the most rearward point of the backhoe is within the turning radius of the machine, meaning that the operator need not be concerned about the rear part of the backhoe hitting something during a turning maneuver.

Figure 8:
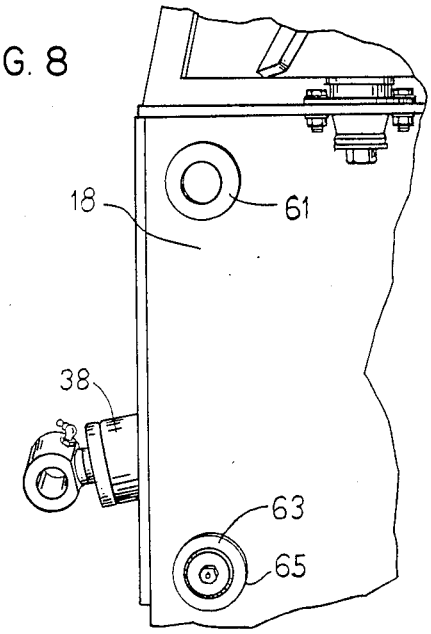
FIG. 8 is a fragmentary view of the front portion of the frame of the machine.

A feature of this invention is the use of positioning means for accurately positioning subframe 20 at either of two locations, for facilitating the securing of the subframe to the main frame 18 at either the work position or the transport position. FIG. 8 of the drawing shows a fragmentary view of the main frame 18 with the subframe 20 removed. In this view two bushings 61 and 63 are shown. The bushing 61 is located in the upper opening in the main frame and provides a dynamic connection between pin 28 and frame 18 for pivoting the subframe 20 relative to main frame 18. The bushing 63 is located in the lower opening in frame 18 and includes an annular outwardly projecting rim 65, that is, the rim projects outwardly beyond frame 18.

Figure 9:
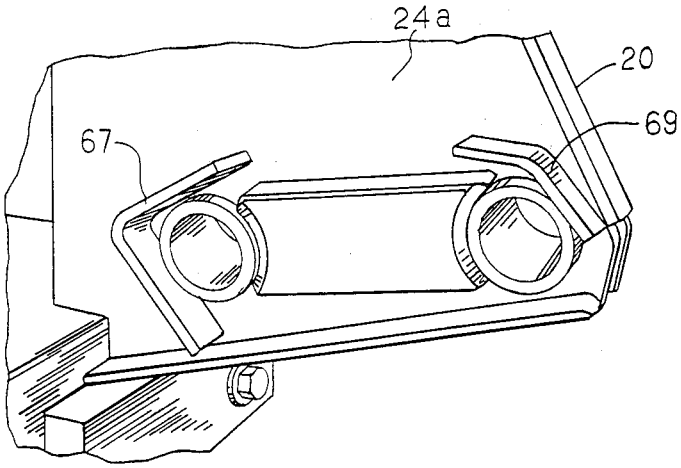
FIG. 9 is a fragmentary view of the inside surface of a portion of the subframe of the machine.

To cooperate with rim 65 in accurately locating subframe 20 in the work position or the transport position there are provided bosses 67 and 69 on the inside surface 24*a* of bracket 24. See FIG. 9. Boss 67 is welded to the inner surface of bracket 24, and abuts the rim 65 when the subframe is at the transport position. Boss 69 abuts rim 65 when subframe 20 is at the work position. Both bosses 67 and 69 project inwardly from the inner surface 24*a* of bracket 24 so that one of them abuts rim 65 of bushing 63 at each of the two extreme positions of subframe 20.

While we have described and illustrated herein a preferred embodiment of our invention which is also the best mode contemplated for carrying it out, it will be understood that changes and modifications may be made. It should be understood, therefore, that we intend to cover by the appended claims all such changes and modifications which fall within the true spirit and scope of our invention.

We claim:

1. A mechanism for mounting a backhoe on a vehicle which has a frame portion located near one end of the vehicle, comprising a backhoe mounting subframe pivotally connected to said frame portion about a transverse axis adjacent the upper margin of the frame portion, said subframe having a downwardly extending work position and a transport position in which it is pivoted upwardly and outwardly from said work position, first means for selectively pivoting said subframe between said work position and said transport position, second means for selectively latching said subframe to said frame portion at said work position or at said transport position, said second means comprising a transversely extending hydraulic cylinder mounted on said frame portion and a pair of pins mounted adjacent opposite ends of said hydraulic cylinder which engage mating openings in said subframe, and positioning means for accurately positioning said subframe relative to said frame, said positioning means comprising at least one bushing in a first opening in said frame portion through which one of said pins extends, and a boss on said subframe which abuts said bushing when a mating opening in said subframe is in alignment with said first opening.

2. A mechanism for mounting a backhoe on a vehicle which has a frame portion located near one end of the vehicle, comprising a backhoe mounting subframe pivotally connected to said frame portion about a transverse axis adjacent the upper margin of the frame portion, said subframe having a downwardly extending work position and a transport position in which it is pivoted upwardly and outwardly from said work position, first means for selectively pivoting said subframe between said work position and said transport position, second means for selectively latching said subframe to said frame portion at said work position or at said transport position, said second means comprising a transversely extending hydraulic cylinder mounted on said frame portion and a pair of pins mounted adjacent opposite ends of said hydraulic cylinder which engage mating openings in said subframe, two pairs of openings in said subframe, one pair when engaged by said pins providing said work position for said subframe, and the other pair when engaged by said pins providing said transport position, and positioning means for accurately defining said work position and said transport position of said subframe, said positioning means comprising two oppositely disposed openings in said frame through which said pins extend, a pair of bushings in said oppositely disposed openings respectively, said bushings each having a projection extending outwardly of said frame, and means on said subframe for abutting said bushing projection when the subframe is at one of said positions.

3. A mechanism as in claim 2 which includes boss means on said subframe for abutting said bushing projections when said subframe is at the other of said positions.

4. A mechanism for mounting a backhoe on a vehicle which has a frame portion located near one end of the vehicle, comprising a backhoe mounting subframe pivotally connected to said frame portion about a transverse axis adjacent the upper margin of the frame portion, said subframe having a downwardly extending work position and a transport position in which it is pivoted upwardly and outwardly from said work position, first means for selectively pivoting said subframe between said work position and said transport position, second means for selectively latching said subframe to said frame portion at said work position or at said transport position, said second means comprising a transversely extending hydraulic cylinder mounted on said frame portion and a pair of pins mounted adjacent opposite ends of said hydraulic cylinder which engage mating openings in said subframe, two pairs of openings in said subframe, one pair when engaged by said pins providing said work position for said subframe, and the other pair when engaged by said pins providing said transport position, two oppositely disposed openings in said frame through which said two pins extend, and two bushings in said openings respectively, each of said bushings having a projection extending outwardly of said frame, and arranged so that said projections abut said subframe in said digging position and said transport position respectively.

5. A mechanism as in claim 4 which includes four bosses on said subframe, two of said bosses abutting said bushings in said digging position, and the other two said bosses abutting said bushings in said transport position.

* * * * *